US006082568A

United States Patent [19]

Flanagan

[11] Patent Number: 6,082,568

[45] Date of Patent: Jul. 4, 2000

[54] CONTAINERS AND CAPS HAVING TAMPER-EVIDENT LINERS

[75] Inventor: Therese A. Flanagan, Chicago, Ill.

[73] Assignee: Kraft Foods, Inc., Northfield, Ill.

[21] Appl. No.: 09/025,137

[22] Filed: Feb. 18, 1998

[51] Int. Cl.[7] ..... B65D 39/00

[52] U.S. Cl. ..... 215/257; 215/232; 215/235; 215/347; 215/348; 215/350; 222/153.07; 222/541.1; 222/556

[58] Field of Search ..... 215/232, 235, 215/237, 238, 254, 255, 257, 347, 349, 350; 220/258, 259, 359.2, 359.3, 359.4; 222/153.05, 153.06, 153.07, 541.1, 541.9, 556

[56] References Cited

U.S. PATENT DOCUMENTS

| | | | |
|---|---|---|---|
| 361,369 | 4/1887 | Petit . | |
| 1,214,746 | 2/1917 | Bell . | |
| 2,925,188 | 2/1960 | Grumbles . | |
| 3,812,991 | 5/1974 | Wolf et al. . | |
| 4,126,245 | 11/1978 | Baroody . | |
| 4,533,062 | 8/1985 | Krautkramer . | |
| 4,682,702 | 7/1987 | Gach . | |
| 4,722,449 | 2/1988 | Dubach . | |
| 4,724,978 | 2/1988 | Cleevely et al. . | |
| 4,727,999 | 3/1988 | Gach . | |
| 4,739,892 | 4/1988 | Tudek | 215/232 |
| 4,760,931 | 8/1988 | Gach . | |
| 4,782,967 | 11/1988 | Thomas | 215/231 |
| 4,815,618 | 3/1989 | Gach | 215/232 |
| 4,819,819 | 4/1989 | Robertson, Jr. . | |
| 4,993,606 | 2/1991 | Bolen, Jr. et al. | 215/235 X |
| 5,094,361 | 3/1992 | Dubach . | |
| 5,184,746 | 2/1993 | Moore et al. | 220/256 X |
| 5,456,294 | 10/1995 | Tsao et al. . | |
| 5,551,608 | 9/1996 | Moore et al. | 215/232 X |

FOREIGN PATENT DOCUMENTS

| | | |
|---|---|---|
| 15808 | 1/1938 | Germany . |
| 11165 | 10/1961 | Pakistan . |
| 6017 | 8/1906 | United Kingdom . |
| 705816 | 3/1954 | United Kingdom . |

*Primary Examiner*—Stephen K. Cronin
*Attorney, Agent, or Firm*—Fitch, Even, Tabin & Flannery

[57] ABSTRACT

The present invention provides containers and container caps for salad dressings, ketchup, barbecue sauces and other dispensable contents, which have liners which indicate whether or not the containers have been tampered with, and which may be removed by the user without the use a knife or similar tool.

34 Claims, 2 Drawing Sheets

Fig. 3
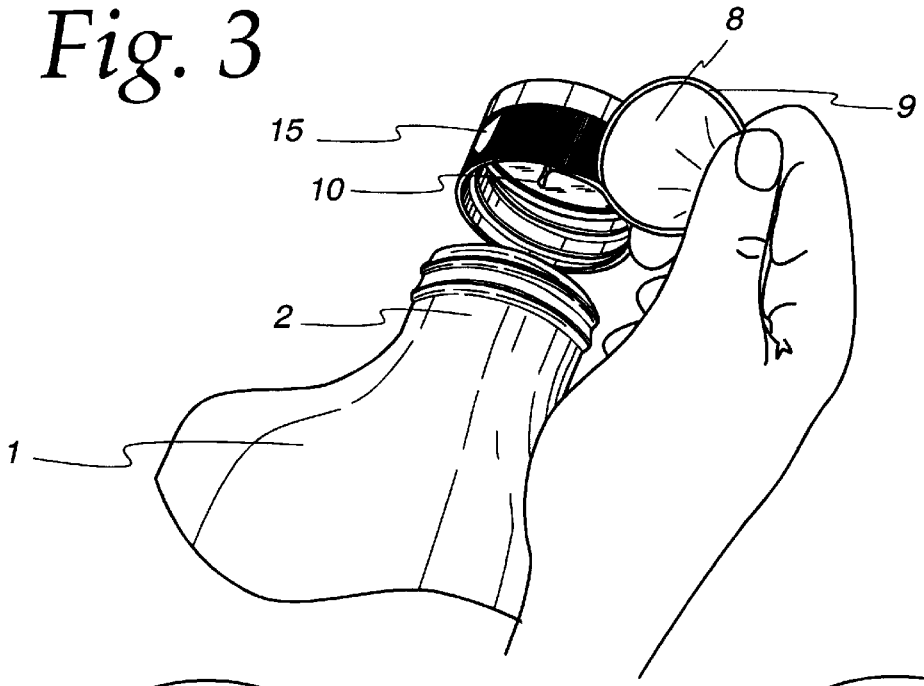
Fig. 4
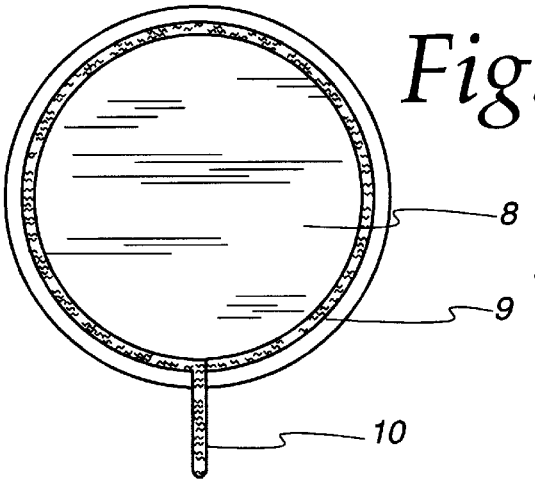
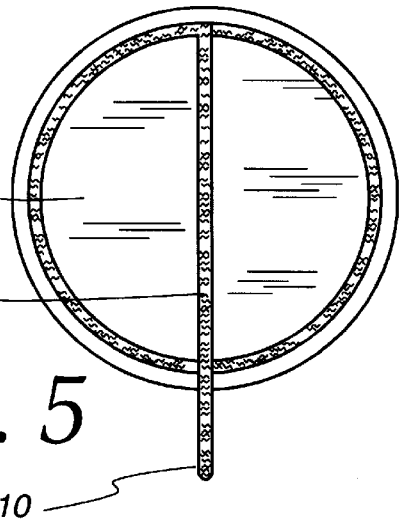
Fig. 5
Fig. 6
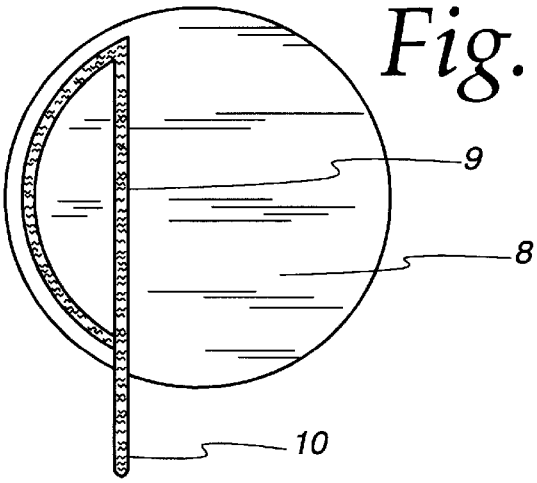
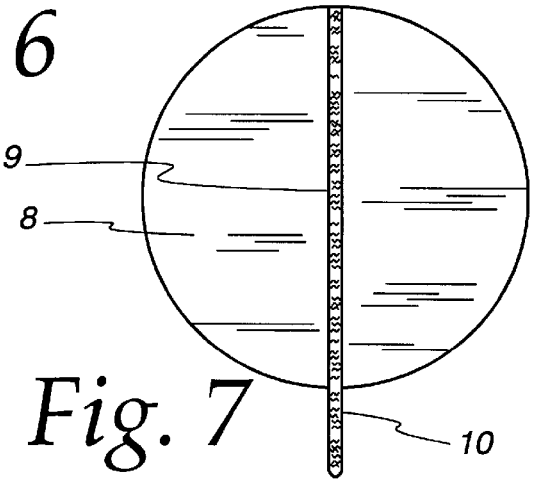
Fig. 7

CONTAINERS AND CAPS HAVING TAMPER-EVIDENT LINERS

BACKGROUND OF THE INVENTION

1. Field of the Invention

The present invention generally relates to containers and caps, and more particularly pertains to containers and caps which have tamper-evident liners which may easily be removed without the use of a knife or other similar tool.

2. Background and Description of Related Art

Background

It is desirable for a container of, for example, salad dressing, ketchup, barbecue sauce or other pourable food items, and/or its cap, to have a tamper-indicating feature which will alert a prospective purchaser that the container has been previously opened or tampered with.

Most containers of pourable food items contain a membrane seal either across the mouth of the containers or inside of the caps for the containers. In order to gain access to the contents of the containers, the user will generally have to remove the cap from the container and use some type of an instrument, such as a knife or similar tool, to cut the membrane seal away from the container or cap. This can be inconvenient and time-consuming for the user, especially when no tool for cutting the membrane seal is readily available. In addition, the use of a knife or similar tool for this purpose can be dangerous for the user. This can also be dangerous for the user's young children when the tool is not kept safely out of the reach of the children, or is not replaced to a safe place after its use.

It would be desirable for containers to have a tamper-indicating hermetic liner either across the mouth of the containers or inside of the caps for the containers which may be removed by the user in a simple manner without the use of a knife or other similar tool. It would also be desirable to have such a liner which is inexpensive, and which may be automatically mass produced in a cost-effective manner.

Description of the Related Art

U.S. Pat. No. 1,214,746 discloses a paper cap which encloses the mouth and lip, as well as a significant portion of the neck, of a milk bottle.

U.S. Pat. No. 2,915,188 discloses a seal for containers of coffee and other products which is initially present in a removable closure cap for the containers, and contains a disc of material adjacent to the underside of the closure cap. As the containers are passed through a screw capping machine, the closure caps are applied to the containers. The disc with the tear tape beneath it is then pressed against the rim of the container and becomes bonded thereto.

U.S. Pat. No. 3,812,992 discloses an infant feeding package which is readied for feeding by tightening a nipple assembly down onto a bottle neck.

U.S. Pat. No. 4,126,245 discloses containers, such as instant coffee jars, to which a wax paper or foil lid is sealed by its gummed underside. A tab or tear string is secured to the wax paper or foil lid, and allows desired portions of the lid to be opened.

U.S. Pat. No. 4,533,062 discloses a container closure which supplies air to, or removes air from, a container.

U.S. Pat. No. 4,682,702 discloses a dispensing closure having a sealing diaphragm covering a central, circular dispensing orifice through which the contents of a container are dispensed. The sealing diaphragm can be removed as a spiral tear strip by gripping the pull tab and lifting it away from the container.

U.S. Pat. No. 4,722,449 discloses a container closure which has an opening for pouring which can be closed by a hinged cap, and which has a means for piercing a pierceable seal on the base of the closure.

U.S. Pat. No. 4,724,978 discloses a unitary, rectangularly—or cylindrically-shaped plastic container which has an integrally-molded, reclosable lid.

U.S. Pat. No. 4,727,999 discloses a dispensing closure and container package in which the closure is affixed to the container so that it cannot be removed, requiring dispensing through a dispensing orifice in the closure top.

U.S. Pat. No. 4,760,931 discloses a circular, plastic disk insert which is snapped into a recess which is present in the neck of a container.

U.S. Pat. No. 4,819,819 discloses a three-part closure for a container which is integrally mated (welded) to the container throat.

U.S. Pat. No. 5,094,361 discloses a one-piece closure for a container which has a bottom part which contains a pouring spout connected with a cap via a hinge.

U.S. Pat. No. 5,456,294 discloses a bottle cap device for preventing spillage during installation when a water bottle is inverted and loaded onto a water dispenser.

British Patent No. 6017 discloses a bottle closing device comprising a cover and a fixing ring.

British Patent No. 705,816 discloses containers which have one end completely closed off, and the other end closed with a removable, tearable plastic material having a tear string.

French Patent No. 361,369 discloses a method for forming a hermetic closure for vessels to prevent fermentation and deterioration of the material (preserves, etc.) contained in the vessels.

German Patent No. 158808 discloses an arrangement for joining together elongated, thin-wall, supporting members of markedly profiled cross-section.

Pakistani Patent No. 111165 discloses reusable bottle sealing caps which protect the neck of bottles from dirt and contamination.

SUMMARY OF THE INVENTION

The present invention provides a novel frangible liner which is suitable for use in induction-sealed containers and which is capable of economical mass production with a sufficiently high degree of reliability to be suitable for large scale commercial use on consumer products. The invention provides containers and container caps which have easily-removable, tamper-indicating liners having tear members for fracturing the liners. The tear member fractures (cuts) the liner when a pulling force is applied to a pull tab which is present at one end of the tear member. This is advantageous in that no knife or other tool need be used to cut or puncture the liner in order to gain access to the contents of the container, and to allow the contents of the container to pour through a dispensing orifice which is present in the container cap to the outside environment. The pull tab can either be pulled in a manner which extends in a straight line across a diameter (or other off-center area) of the liner, or which extends around the circumference of the liner. The container caps of the present invention may have liners which have pull tabs which are grippable from the inside of the base cap portion of the container caps, and which are manually pulled by the user in order to affect the removal of the liners. Alternatively, and preferably, the containers and container caps may have the pull tabs arranged in a manner that they are automatically pulled when the container cap is removed from the container.

The containers and container caps of the present invention are also advantageous in that they will alert a prospective purchaser as to whether or not the container has previously been opened and, perhaps, tampered with. The integrity of the container may be checked by lifting the cover lid portion of the container cap up and open, and observing the presence or absence of the liner, or the condition of a liner which is secured to the rim of the container, or which is present in the container cap.

In one embodiment, the present invention provides a container cap for use with a container having the removable liner adjacent to the underside of the base cap portion of the container cap. A tear member secured to the liner has a pull tab which protrudes from the liner in a manner in which it may be gripped by the user from the inside of the base cap portion of the container cap, and is arranged so as to provide tearing of the liner in a straight line across a diameter of the liner, or across any other area of the liner, from one side of the base cap to the other side of the base cap, when the user pulls the pull tab.

In a second embodiment, the present invention provides a container cap as described above for the first embodiment, except that the tear member is arranged so as to provide a tearing of the liner around the circumference of the liner when the user pulls the pull tab.

In a third embodiment, the present invention provides a container cap as described above for the first embodiment, except that the pull tab is connected with threads which are present on the outside of the neck of the container, or is connected to some other part of the container. Thus, when the user unscrews, or otherwise removes, the container cap from the container, this has the effect of automatically tearing the liner in a straight line across a diameter of the liner, or across any other area of the liner, from one side of the base cap to the other side of the base cap.

In a fourth embodiment, the present invention provides a container cap as described above for the second embodiment, except that the pull tab is connected with threads which are present on the outside of the neck of the container, or is connected to some other part of the container. Thus, when the user unscrews, or otherwise removes, the container cap from the container, this has the effect of automatically tearing the liner around the circumference of the liner.

The present invention also provides a container having a circular or other shape opening closed by a removable liner secured to the rim of the container. The liner has a tear member secured thereto which has a pull tab secured to internal threads which are present in the container cap, or secured to some other part of the container cap. The tear member is arranged so as to provide an automatic tearing of the liner in a straight line across a diameter (or other area) of the liner when the user unscrews, or otherwise removes, the container cap from the container.

Another embodiment of the container of the present invention is a container as described above, except that the tear member is arranged so as to provide an automatic tearing of the liner around the circumference of the liner when the user unscrews, or otherwise removes, the container cap from the container.

BRIEF DESCRIPTION OF THE DRAWINGS

FIG. 3 is a perspective view of the container and cap of FIG. 1, showing the liner being held by a user after having been removed from the container by an automatic tearing of the liner around the circumference of the liner when the user opened the container.

FIG. 4 is a top view of a liner which has a tear member arranged so as to provide a tearing of the liner around the circumference of the liner.

FIG. 5 is a top view of a liner which has a tear member arranged so as to provide both diametric and circumferential tearing of the liner.

FIG. 6 is a top view of a liner which has a tear member arranged so as to provide a tearing of the liner in a straight, but off-center, line across the liner, and along a-portion of the circumference.

FIG. 7 also shows a top view of a liner which has a tear member arranged so as to provide diametric tearing of the liner in a straight line across the center of the liner.

DETAILED DESCRIPTION OF THE PREFERRED EMBODIMENTS

Figure 1:
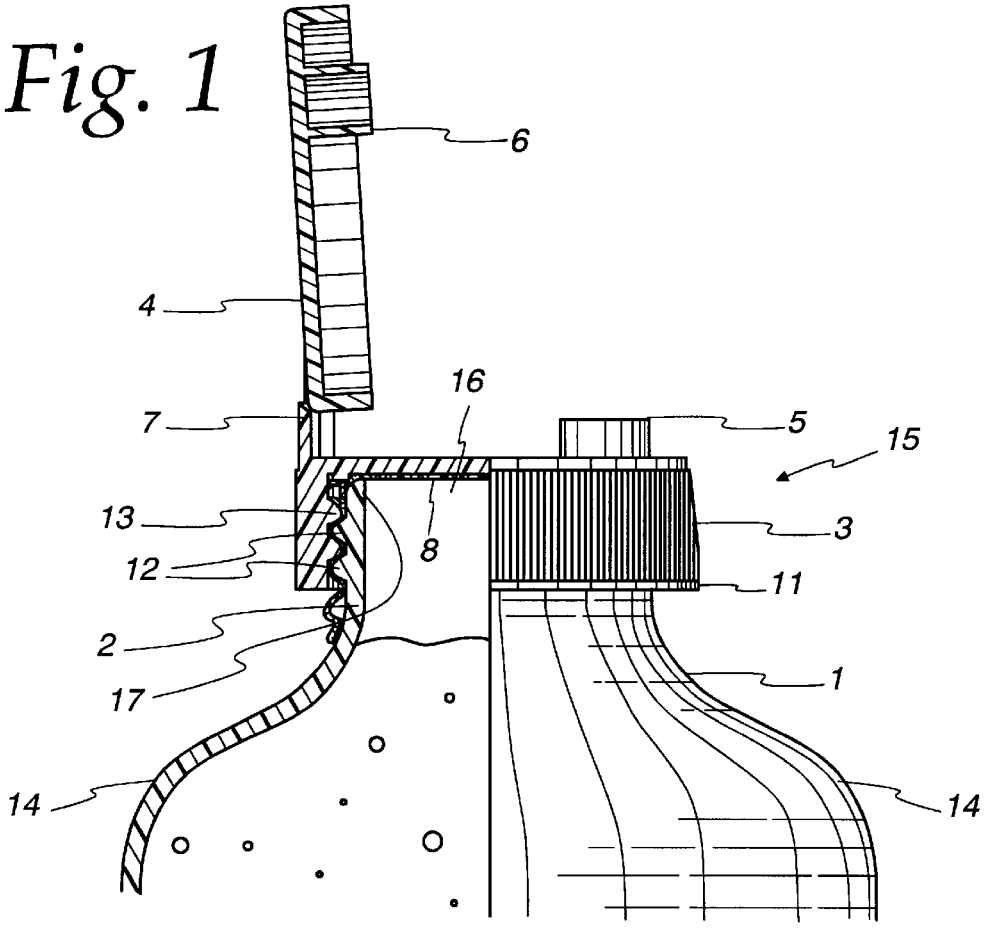
FIG. 1 is a front elevational view of a container and cap in accordance with a first embodiment of the invention, shown partially in section, with the cover lid in open position.

The present invention provides a container cap for use with a container with means for attaching the container cap to the container comprising a base cap having a dispensing orifice therein, a movable cover lid on the base cap, a means for connecting the cover lid to the base cap, a removable liner which is adhered to the underside of the base cap, and which extends across the dispensing orifice prior to its removal, and a tear member secured to the liner.

In a first embodiment, the tear member is secured to the container so as to automatically fracture the liner when the cap is removed. In a second embodiment, the tear member has a pull tab which protrudes from the liner so that it can be gripped from the inside of the base cap portion of the container cap (the part of the base cap which faces, and attaches to, a container).

The tear member may be arranged so as to enable tearing of the liner across the liner from one side of the base cap to the other side of the base cap when a pulling force is applied to the pull tab. Alternatively, the tear member may be arranged so as to enable tearing of the liner around the circumference of the liner when a pulling force is applied to the pull tab.

Specific containers and container caps within the scope of the invention include, but are not limited to, the containers and container caps discussed in detail herein and/or illustrated in the drawings contained herein.

Contemplated equivalents of the containers and container caps described herein and/or illustrated in the drawings contained herein include containers and container caps which otherwise correspond thereto, and which have the same general properties and/or components thereof, wherein one or more simple or other variations of components or materials are made.

For the purpose of illustrating the containers and container caps of the present invention, there are shown in the drawings, which form a material part of this disclosure, several different liners which may be employed in the containers and container caps of the invention, and one of the preferred embodiments of the invention.

The various components of the containers and container caps of the preferred embodiments may be generally arranged in the manner shown in the drawings, or described hereinbelow. However, the present invention is not limited to the precise arrangements, configurations, dimensions and/or instrumentalities shown in these drawings, or described hereinbelow. These arrangements, configurations, dimensions and instrumentalities may be otherwise, as circumstances require.

Different specific embodiments of the containers and container caps of the present invention will now be described with reference to the drawings.

Figure 2:
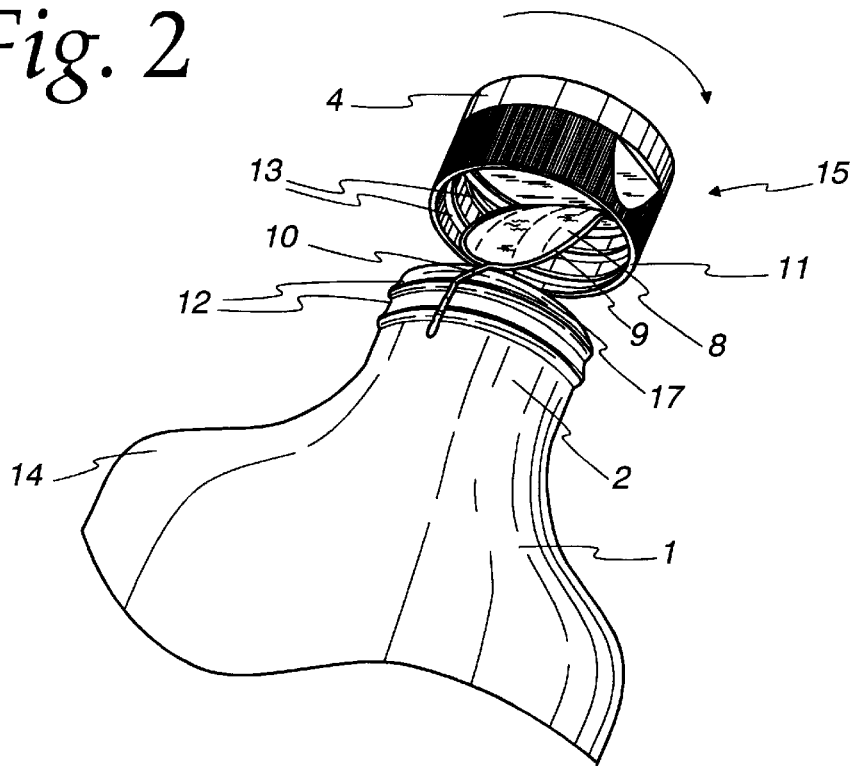
FIG. 2 is a perspective view of the container and cap of FIG. 1, shown with the cover lid in closed position, the liner having been partially removed from the container cap automatically by the opening of the container.

Referring to FIGS. 1–3, there is shown a container cap 15 having a base cap 3, which has a dispensing orifice 5 present therein for dispensing the contents of a container 1 therethrough, and a cover lid 4 for closing the dispensing orifice 5.

The cover lid 4 preferably is detachably connected to the base cap 3 by a hinge 7, which may comprise a pivotal connection or a flexible, bendable strip of material, and may contain an optional cylindrical or other insert 6 for insertion into the dispensing orifice 5. The insert 6 functions as a plug to close off the dispensing orifice 5 once a liner 8 has been removed from the container 1 or container cap 15, and when the cover lid 4 is in a closed position. The cover lid 4 is movable about the hinge 7 between a closed position covering the dispensing orifice 5, with the insert 6 plugging the dispensing orifice 5, and an open dispensing position, with the insert 6 being removed from the dispensing orifice 5. In other embodiments of the invention, the cover lid 4 may be connected with the base cap 3 by other means, or may be separable from the base cap 3 without any permanent connection.

The base cap 3 has an outer skirt 11 and internal threads 13 which are present on the inside of the base cap 3, and which are complementary to threads 12 on the outside of the neck 2 of the container 1. These complementary threads allow the container cap 15 to be screwed onto the container 1.

The container 1 comprises a bottle which has a rim 17 to which an easily-removable, tamper-evident liner 8 may be secured, and a mouth 16 through which the contents of the container 1 may flow. The container 1 may also have shoulders 14 which are broader than the neck 2.

The liner 8 may be adhered to the rim 17 of the container, or to the underside of the base cap 3. In both cases, the liner 8 completely seals the dispensing orifice 5, and must be fractured or removed, in order for the contents of the container 1 to pour through the dispensing orifice 5. By viewing the absence, or condition, of this liner 8, a user will be able to determine whether or not the container 1 has been tampered with. Further, no knife or other tool need be employed to remove this liner 8 from the container cap 15, or from the mouth 16 of the container.

As is shown in FIG. 2, the liner 8 has a tear member 9 which is either secured to the surface of the liner 8, or is embedded within the liner 8.

As is shown in FIGS. 4–7, a pull tab 10 resulting from a free end section of the tear member 9, and which is positioned at the end of the tear member 9, or which is adjacent to one end of the tear member 9, projects from the liner 8, and, in certain embodiments of the invention, allows the user to grip the pull tab 10 and pull it in the appropriate direction (straight across a diameter of the liner 8 for tear members 9 which are arranged across a diameter of the liner 8, and around the circumference of the liner 8 for tear member 9 which are arranged around the circumference of the liner 8).

In the most preferred embodiments of the invention, the pull tab 10 will be automatically pulled when the container cap 15 is unscrewed from, or otherwise removed from, the container 1, thereby either pulling the tear member 9 in a straight line diametrically or otherwise across the liner 8, such that the liner 8 is split into two pieces of the same or differing sizes, or pulling the tear member 9 around the circumference of the liner 8, so that all of the liner 8, with the exception of the portion of the liner 8 which is adhered to the container 1, or to the container cap 15 (FIGS. 2 and 3), will be removed. Thus, the user need not pull the pull tab 10 in order to remove the liner 8 from the container 1 or from the container cap 15. In these embodiments of the invention, when the liner 8 is attached to the container cap 15, the pull tab 10 will be attached to the threads 12 on the neck 2 of the container 1 (or to the rim 17 or any other desirable area of the container 1). Alternatively, when the liner 8 is attached to the rim 17 of the container, the pull tab 10 will be attached to the internal threads 13 in the base cap 3 portion of the container cap 15 (or to any other part of the container cap 15).

As is shown in FIGS. 5–7, the tear member 9 may be arranged in a manner that it will be pulled in a straight line diametrically or otherwise across the liner 8, thereby splitting the liner 8 into two pieces of the same or differing sizes. As is shown in FIG. 4, the tear member 9 may, alternatively, be arranged around the circumference of the liner 8, so that all of the liner 8, with the exception of the portion of the liner 8 which is adhered to the container 1, or to the container cap 15, will be removed from the container 1 or container cap 15 when the tear member 9 is pulled. In this case, the tear member 9 will preferably be offset from the edge of the liner 8 by from about 0.03 to about 0.06 inches. The tear member 9 acts as a knife, and facilitates the removal of the liner 8 by cutting as it is either peeled across the center, or across any area offset from the center, of the liner 8, or is peeled around the circumference of the liner 8.

Container

The container 1 may be of any desired or convenient size. For example, the container 1 may be of a size which holds 12, 16 or 36 ounces of pourable salad dressing.

The container 1 may be of any desired shape, e.g., a shape which is suitable for commercial use with salad dressings, ketchups, barbecue sauces and other similar viscous food items. The illustrated container 1 has a somewhat narrow neck area 2, with broad shoulders 14 which lead to a main body. In one embodiment, the mouth 16 of the container may be, for example, about 1 and ⅜ inches in diameter.

The container 1 may be made of materials such as glass, plastics, or laminates such as paperboard lined with foil, or other materials.

In those embodiments of the present invention in which the liner 8 is secured to the rim 17 of the container, and across the mouth 16 of the container 1, the mouth 16 of the container will be closed off from the outside environment by the liner 8.

Container Cap

The container cap 15 may be of any convenient size, but should be of a size which fits appropriately with the container 1. In one embodiment, for example, the container cap 15 may be about ¾ inch in height and about 1 and ⅝ inch in diameter.

While the shape of the container cap 15 is not critical, the container cap 15 is preferably generally cylindrical in shape. However, other shapes may also be possible.

A band of plastic, paper or other material may, optionally, be adhered to the container 1 and container cap 15 at the place where the container cap 15 meets with the container 1 once the container cap 15 has been screwed onto the container 1 to provide an additional means of tamper indication.

The container cap 15 is preferably injection molded with commercially-available materials such as polypropylene, polyethylene, polystyrene, or other plastics.

Liner

When the liner 8 is attached to the container cap 15, the size and shape of the liner 8 will generally be the size and shape of the circumference of the underside of the base cap 3, which is within the outer skirt 11 of the container cap 15, so that the liner 8 fits with the underside of the base cap 3, with its edges touching the inner portion of the outer skirt 11. When the liner 8 is attached to the container 1, the size and shape of the liner 8 will generally be the size and shape of the portion of the container 1 which includes the mouth 16 and rim 17 of the container.

The liner 8 may be made of any material which is suitable for preventing the contents of the container from pouring through the dispensing orifice 5, such as plastic, paper, paperboard, foil or cardboard. The liner 8 may contain one or more layers of material. Preferably, the liner 8 is made of an induction-sealable laminate of a thermoplastic material and a foil material, which provides a hermetic seal to the contents of the container 1.

The liner 8 may be attached to the rim 17 of the container 1, or to the underside of the base cap 3, by pressure, adhesives, chemical bonding, gluing or heat sealing and, preferably, by induction sealing, with the pull tab 10 extending from the tear member 9. When the liner 8 is adhered to the container cap 15, the liner 8 is preferably sealed to the base cap 3 about its periphery by induction sealing or other heating methods.

Tear Member

The tear member 9 may be, for example, a plastic, copper or steel wire, or a nylon, silk, foil or thin metal tear ribbon, thread, tab, strip, string or tape which is secured to the liner 8 in any suitable manner, such as by chemical bonding, gluing or heat sealing with the use of a sealant coating. However, because induction sealing equipment is not compatible with metal, when the liner 8 is attached to the rim 17 of the container 1, or to the underside of the base cap 3, by induction sealing, the tear member 9 should not be made of metal.

The tear member 9 may be securely attached to the bottom of the liner 8 (the side of the liner 8 which faces the contents of the container 1), or may be embedded within the liner 8, or may be integrally molded with the liner 8, with the pull tab 10 extending from the tear member 9. Preferably, the tear member 9 is a heat-resistant tape which has been reinforced with polymer additives to assure that delamination does not occur within the structure of the tape, and which has a tensile strength which is sufficient to prevent it from breaking when it is pulled.

Operation

In those embodiments of the invention in which the pull tab must be pulled by the user in order to remove the liner from the container cap (i.e., when the pull tab is not automatically pulled when the container cap is unscrewed from the container), the user may perform the following steps: (1) lift the cover lid of the container cap to inspect the liner; (2) unscrew or otherwise remove the container cap from the container; (3) grip the pull tab which is present inside the base cap of the container cap and pull it until the liner is either split into two pieces, or until the liner becomes removed; (4) peel the two pieces of the liner off from the container cap (only where the tear member was arranged to split the liner); (5) screw or otherwise secure the container cap back onto the container; (6) pour a portion of the contents of the container through the dispensing orifice; and (7) close the cover lid.

In those embodiments of the invention in which the pull tab need not be pulled by the user, the user will generally perform the following steps: (1) lift the cover lid to inspect the liner; (2) unscrew or otherwise remove the container cap from the container; (3) manually remove the two pieces of the liner from the container or cap (only where the tear member was arranged to split the liner); (4) screw or otherwise place the container cap back onto the container; (5) pour a portion of the contents of the container through the dispensing orifice; and (6) close the cover lid.

Assembly

The container caps and containers of the present invention are preferably mass produced.

In those embodiments of the invention in which the liner is attached to the underside of the base cap portion of the container cap, the tear member is attached to the bottom of the liner, or is embedded within the liner, in the manner described hereinabove. The liner containing the tear member and pull tab arranged in the desired manner is then attached to the injection-molded base cap in the manner described hereinabove. Containers which have passed through a filler, and which have been filled with the desired material, pass through a capping machine which applies the container caps to the containers in a manner such that the pull tabs extending from the tear members either remain free to be pulled by the user, or are connected to threads which are present on the necks of the containers, or to other desired areas of the containers, so that they will be automatically pulled when the container caps are removed from the containers.

In those embodiments of the invention in which the liner is attached to the rim of the container, the above-described liner may be carried within the container cap, and sealed during the application of the container cap. A packer passes filled containers under a roller which applies an adhesive to the rim of the container. The container with adhesive on the rim passes through a capping machine which applies the screw cap to the container and presses the liner in the container cap against the rim of the container. The high pressure or heat applied bonds the liner through the adhesive to the rim of the container. When the container cap is removed, the bonded liner remains on the rim of the container. The container caps will be applied to the containers such that the pull tabs extending from the tear members are connected to the internal threads present in the container caps, or to other desired areas of the container caps, so that they will be automatically pulled when the container caps are removed from the containers.

Although certain preferred embodiments of the containers and container caps of the present invention have been shown and described herein, those of ordinary skill in the art will recognize numerous variations, modifications and substitutions of that which has been described herein which may be made therein, as by adding, combining, subdividing parts or steps, or by substituting equivalents, while retaining significant advantages of the containers and container caps of the present invention, which are defined in the following claims. It is intended, therefore, that all of these modifications, variations and substitutions be within the scope and spirit of the present invention as described and claimed herein, and that the invention be limited only by the scope of the claims which follow, and that such claims be interpreted as broadly as possible.

What is claimed is:

1. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner across said liner from one side of said base cap to the other side of said base cap when a pulling force is applied to said pull tab;

wherein said liner comprises one or two layers of the same or different materials, wherein said materials are plastic, paper, paperboard, foil or cardboard, and is adhered to the underside of said base cap by adhesives, chemical bonding, gluing or induction sealing; and wherein said tear member is a plastic wire, or a nylon, silk or foil tear ribbon, thread, tab, strip, string or tape which is secured to said liner by chemical bonding, gluing or heat sealing.

2. The container cap of claim 1 wherein said tear member is attached to the bottom of said liner, is embedded within said liner or is integrally molded within said liner.

3. The container cap of claim 2 wherein said liner is an induction-sealable laminate of a thermoplastic material and a foil material and is adhered to the underside of said base cap by induction sealing, and said tear member is a heat-resistant tape reinforced with polymer additives which is integrally molded within said liner, and which has a tensile strength which is sufficient to prevent said tear member from breaking when said tear member is pulled.

4. The container cap of claim 3 wherein said means for attaching said container cap to said container comprises complementary threads, and said means for connecting said cover lid to said base cap comprises a hinge.

5. The container cap of claim 4 wherein said container cap is cylindrical in shape, and is made from polypropylene, polyethylene or polystyrene.

6. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner around the circumference of said liner when a pulling force is applied to said pull tab;

wherein said liner comprises one or two layers of the same or different materials, wherein said materials are plastic, paper, paperboard, foil or cardboard, and is adhered to the underside of said base cap by adhesives, chemical bonding, gluing or induction sealing; and wherein said tear member is a plastic wire, or a nylon, silk or foil tear ribbon, thread, tab, strip, string or tape which is secured to said liner by chemical bonding, gluing or heat sealing.

7. The container cap of claim 6 wherein said tear member is attached to the bottom of said liner, is embedded within said liner or is integrally molded within said liner.

8. The container cap of claim 7 wherein said liner is an induction-sealable laminate of a thermoplastic material and a foil material and is adhered to the underside of said base cap by induction sealing, and said tear member is a tape reinforced with polymer additives which is integrally molded within said liner, and which is offset from the edge of said liner by from about 0.03 to about 0.06 inches.

9. The container cap of claim 8 wherein said means for attaching said container cap to said container comprises complementary threads, and said means for connecting said cover lid to said base cap comprises a hinge.

10. The container cap of claim 9 wherein said container cap is cylindrical in shape, and is made from polypropylene, polyethylene or polystyrene.

11. A container cap for use with a bottle comprising:

(a) a base cap having a dispensing orifice therein;

(b) a movable cover lid on said base cap;

(c) a hinge which connects said cover lid to said base cap;

(d) a removable liner which is adhered to the underside of said base cap, and which extends across said dispensing orifice prior to its removal; and (e) a tear member secured to said liner, and having a pull tab which protrudes from said liner, and which is secured to said bottle.

12. The container cap of claim 11 wherein said pull tab is secured to the rim of the neck of said bottle or to external threads present on the neck of said bottle.

13. The container cap of claim 12 wherein said liner contains one or two layers of the same or different materials, wherein said materials are plastic, paper, paperboard, foil or cardboard, and is adhered to the underside of said base cap by adhesives, chemical bonding, gluing or induction sealing, wherein said tear member is not made of metal when said liner is adhered to said base cap by induction sealing.

14. The container cap of claim 13 wherein said tear member is a plastic wire, or a nylon, silk or foil or tear ribbon, thread, tab, strip, string or tape which is secured to said liner by chemical bonding, gluing or heat sealing.

15. The container cap of claim 14 wherein said tear member is attached to the bottom of said liner, is embedded within said liner or is integrally molded within said liner.

16. The container cap of claim 15 wherein said liner is an induction-sealable laminate of a thermoplastic material and a foil material and is adhered to the underside of said base cap by induction sealing, and said tear member is a tape reinforced with polymer additives which is integrally molded within said liner.

17. The container cap of claim 16 wherein said tear member is arranged so as to enable tearing of said liner across said liner from one side of said base cap to the other side of said base cap when said container cap is removed from said bottle.

18. The container cap of claim 16 wherein said tear member is offset from the edge of said liner by from about 0.03 to about 0.06 inches, and is arranged so as to enable tearing of said liner around the circumference of said liner when said container cap is removed from said bottle.

19. A container comprising:

(a) a container cap comprising:

(1) a base cap having a dispensing orifice therein;

(2) a movable cover lid on said base cap; and (3) a hinge which connects said cover lid to said base cap; and (b) a container having a circular opening closed by a removable liner secured to the rim of said container, said liner having a tear member secured thereto, and said tear member having a pull tab which protrudes from said liner, and which is secured to said container cap, said tear member being arranged so as to enable tearing of said liner across said liner from one side of said container to the other side of said container when said container cap is removed from said container; and (c) means for connecting said container cap to said containing; wherein said pull tab is secured to internal threads present within said base cap.

20. The container of claim 19 wherein said liner contains one or two layers of the same or different materials, wherein said materials are plastic, paper, paperboard, foil or cardboard, and is secured to said rim by adhesives, chemical bonding, gluing or induction sealing, wherein said tear member is not made of metal when said liner is adhered to said rim by induction sealing.

21. The container of claim 20 wherein said tear member is a plastic wire, or a nylon, silk or foil tear ribbon, thread, tab, strip, string or tape which is secured to said liner by chemical bonding, gluing or heat sealing.

22. The container of claim 21 wherein said tear member is attached to the bottom of said liner, is embedded within said liner or is integrally molded within said liner.

23. The container of claim 22 wherein said liner is an induction-sealable laminate of a thermoplastic material and a foil material, and said tear member is a nylon tape reinforced with polymer additives which is integrally molded within said liner.

24. A container comprising:

(a) a container cap comprising:

(1) a base cap having a dispensing orifice therein;

(2) a movable cover lid on said base cap; and (3) a hinge which connects said cover lid to said base cap; and (b) a container having a circular opening closed by a removable liner secured to the rim of said container, said liner having a tear member secured thereto, and said tear member having a pull tab which protrudes from said liner, and which is secured to said container cap, said tear member being arranged so as to enable tearing of said liner around the circumference of said liner when said container cap is removed from said container; and (c) means for connecting said container cap to said container; wherein said pull tab is secured to internal threads present within said base cap.

25. The container of claim 24 wherein said liner contains one or two layers of the same or different materials, wherein said materials are plastic, paper, paperboard, foil or cardboard, and is secured to said rim by adhesives, chemical bonding, gluing or induction sealing, wherein said tear member is not made of metal when said liner is adhered to said rim by induction sealing.

26. The container of claim 25 wherein said tear member is a plastic wire, or a nylon, silk or foil tear ribbon, thread, tab, strip, string or tape which is secured to said liner by chemical bonding, gluing or heat sealing.

27. The container of claim 26 wherein said tear member is attached to the bottom of said liner, is embedded within said liner or is integrally molded within said liner.

28. The container of claim 27 wherein said liner is an induction-sealable laminate of a thermoplastic material and a foil material and said tear member is a tape reinforced with polymer additives which is integrally molded within said liner, and which is offset from the edge of said liner by from about 0.03 to about 0.06 inches.

29. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner across said liner from one side of said base cap to the other side of said base cap when a pulling force is applied to said pull tab;

wherein said liner comprises one or two layers of the same or different materials, wherein said materials are plastic, paper, paperboard, foil or cardboard, and is adhered to the underside of said base cap by adhesives, chemical bonding, gluing or induction sealing; and wherein said tear member is a copper or steel wire, or a thin metal tear ribbon, thread, tab, strip, string or tape which is secured to said liner by chemical bonding, gluing or heat sealing with the use of a sealant coating, wherein the heat sealing method used is not induction sealing.

30. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner across said liner from one side of said base cap to the other side of said base cap when a pulling force is applied to said pull tab;

wherein said liner comprises one or two layers of the same or different plastic materials, and is adhered to the underside of said base cap by heat sealing; and wherein said tear member is a plastic wire, or a nylon, silk or foil tear ribbon, thread, tab, strip, string or tape which is secured to said liner by chemical bonding, gluing or heat sealing.

31. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner across said liner from one side of said base cap to the other side of said base cap when a pulling force is applied to said pull tab;

wherein said liner comprises one or two layers of the same or different plastic materials, and is adhered to the underside of said base cap by heat sealing; and wherein said tear member is a copper or steel wire, or a thin metal tear ribbon, thread, tab, strip, string or tape which is secured to said liner by chemical bonding, gluing or heat sealing with the use of a sealant coating, wherein the heat sealing method used is not induction sealing.

32. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner around the circumference of said liner when a pulling force is applied to said pull tab;

wherein said liner comprises one or two layers of the same or different materials, wherein said materials are plastic, paper, paperboard, foil or cardboard, and is adhered to the underside of said base cap by adhesives, chemical bonding, gluing or induction sealing; and wherein said tear member is a copper or steel wire, or a thin metal tear ribbon, thread, tab, strip, string or tape which is secured to said liner by chemical bonding, gluing or heat sealing with the use of a sealant coating, wherein the heat sealing method used is not induction sealing.

33. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner around the circumference of said liner when a pulling force is applied to said pull tab;

wherein said liner comprises one or two layers of the same or different plastic materials, and is adhered to the underside of said base cap by heat sealing; and wherein said tear member is a plastic wire, or a nylon, silk or foil tear ribbon, thread, tab, strip, string or tape which is secured to said liner by chemical bonding, gluing or heat sealing.

34. A container cap for use with a container with means for attaching said container cap to said container comprising:

(a) a base cap having a dispensing orifice therein;

(b) a movable cover lid on said base cap;

(c) a means for connecting said cover lid to said base cap;

(d) a removable liner which is adhered to the underside of said base cap, and which extends across said dispensing orifice prior to its removal; and (e) a tear member secured to said liner, and having a pull tab which protrudes from said liner in a manner that it can only be gripped from the inside of said base cap, said tear member being arranged so as to enable tearing of said liner around the circumference of said liner when a pulling force is applied to said pull tab;

wherein said liner comprises one or two layers of the same or different plastic materials, and is adhered to the underside of said base cap by heat sealing; and wherein said tear member is a copper or steel wire, or a thin metal tear ribbon, thread, tab, strip, string or tape which is secured to said liner by chemical bonding, gluing or heat sealing with the use of a sealant coating, wherein the heat sealing method used is not induction sealing.

* * * * *